US006529095B1

(12) United States Patent
Kanno

(10) Patent No.: US 6,529,095 B1
(45) Date of Patent: Mar. 4, 2003

(54) ANTENNA DUPLEXER

(75) Inventor: Susumu Kanno, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/686,692

(22) Filed: Oct. 11, 2000

(30) Foreign Application Priority Data

Oct. 12, 1999 (JP) ..... 11-289661

(51) Int. Cl.[7] ..... H01P 1/213
(52) U.S. Cl. ..... 333/134; 333/103; 333/104
(58) Field of Search ..... 333/103, 104, 333/134

(56) References Cited

U.S. PATENT DOCUMENTS 5,903,820 A * 5/1999 Hagstrom ..... 455/82
5,909,641 A * 6/1999 Simmons ..... 333/104
6,313,797 B1 * 12/2001 Kurita et al. ..... 333/134

FOREIGN PATENT DOCUMENTS

JP 06-77707 3/1994 ..... H01P/1/213
JP 11-243304 9/1999 ..... H01P/1/213

* cited by examiner

*Primary Examiner*—Benny Lee
*Assistant Examiner*—Damian Cathey
(74) *Attorney, Agent, or Firm*—Brinks Hofer Gilson & Lione

(57) ABSTRACT

The cost of an antenna duplexer is reduced by decreasing the number of parts for antenna switching, and the size thereof is reduced by reducing the space of a printed-circuit board on which a receiving circuit and a transmission circuit are formed. The antenna duplexer includes an antenna, a transmission circuit, a receiving circuit, a first transmission line for connecting the transmission circuit to the antenna, and a second transmission line for connecting the receiving circuit to the antenna, wherein the length of the first transmission line is set to be approximately a quarter of the wavelength of the transmission frequency, and the length of the second transmission line is set to be approximately a quarter of the wavelength of the receiving frequency.

12 Claims, 3 Drawing Sheets

ANTENNA DUPLEXER

BACKGROUND OF THE INVENTION

1. Field of the Invention

The present invention relates to an antenna duplexer for transmitting data, in which the transmission frequency is the same as the receiving frequency and an antenna is shared.

2. Description of the Related Art

FIG. 7 shows the construction of a conventional antenna duplexer, in which a transmission circuit 31 and a receiving circuit 32 are connected to an antenna 34 via an antenna switching circuit 33. The antenna switching circuit 33 is formed, together with the transmission circuit 31 and the receiving circuit 32, on a printed-circuit board (not shown).

The antenna switching circuit 33 basically has a transmission line 33*a* having a length of a quarter of the wavelength of the transmission and receiving frequency, and two switching diodes 33*b* and 33*c*. The transmission line 33*a* is formed by a conductor attached to the printed-circuit board. One end of the transmission line 33*a* and the cathode of the first switching diode 33*b* are connected to each other, and the connection point thereof is connected to the antenna 34. Also, the anode of the second switching diode 33*c* is connected to the other end of the transmission line 33*a*, and the cathode thereof is grounded. The output end of the transmission circuit 31 is connected to the anode of the first switching diode 33*b*, and the input end of the receiving circuit 32 is connected the other end of the transmission line 33*a*.

Then, during transmission, a transmission or receiving switching voltage is applied to the anode of the first switching diode 33*b* via a choke inductor 33*d*. Thereupon, the first switching diode 33*b* and the second switching diode 33*c* conduct. In this state, a transmission signal output from the transmission circuit 31 passes through the first switching diode 33*b* and is output to the antenna 34. At this time, since the second switching diode 33*c* also conducts, the transmission signal input to the transmission line 33*a* side is totally reflected by the second switching diode 33*c* and is not input to the receiving circuit 32.

On the other hand, during reception, a switching voltage is not applied to the anode of the first switching diode 33*b*. Then, the first switching diode 33*b* and the second switching diode 33*c* do not conduct. Therefore, the signal received by the antenna 34 is input to the receiving circuit 32 after passing through the transmission line 33*a* without being input to the transmission circuit 31.

In a conventional antenna duplexer, the antenna switching circuit 33 uses two switching diodes and requires a choke inductor for applying a switching voltage. For this reason, a space for arranging these components must be provided on a printed-circuit board, the printed-circuit board becomes enlarged, and the size of the antenna duplexer cannot be reduced.

Also, since the number of parts used is large, this accordingly results in high cost.

SUMMARY OF THE INVENTION

Accordingly, an object of an antenna duplexer of the present invention is to reduce cost by decreasing the number of parts for antenna switching and to reduce the size by reducing the space of a printed-circuit board on which a receiving circuit and a transmission circuit are formed.

To achieve the above-mentioned object, according to the present invention, there is provided an antenna duplexer comprising: an antenna, a transmission circuit, a receiving circuit, a first transmission line for connecting the transmission circuit to the antenna, and a second transmission line for connecting the receiving circuit to the antenna, wherein the length of the first transmission line is set to be approximately a quarter of the wavelength of the transmission frequency, and the length of the second transmission line is set to be approximately a quarter of the wavelength of the receiving frequency.

In the antenna duplexer of the present invention, a first switching diode for shunting a connection point of the first transmission line and the transmission circuit to a ground is provided, and the first switching diode is turned off at the time of transmission and is turned on at the time of reception.

In the antenna duplexer of the present invention, a second switching diode for shunting a connection point of the second transmission line and the receiving circuit to a ground is provided, and the second switching diode is turned off at the time of reception and is turned on at the time of transmission.

In the antenna duplexer of the present invention, a dielectric block in the form of a rectangular parallelepiped is provided, a first strip conductor, and second and third strip conductors which branch from nearly the center along the length of the first strip conductor are formed on the surface of the dielectric block, the first strip conductor is used as the antenna, the second strip conductor is used as the first transmission line, and the third strip conductor is used as the second transmission line.

In the antenna duplexer of the present invention, a first terminal connected to an end portion of the first strip conductor, a second terminal connected to an end portion of the second strip conductor, and a third terminal connected to an end portion of the third strip conductor are formed on the surface of the dielectric block, a printed-circuit board, on which the transmission circuit and the receiving circuit are formed, is provided, the dielectric block is mounted on the printed-circuit board, the first terminal is connected to a grounding conductor provided on the printed-circuit board, the second terminal is connected to the transmission circuit, and the third terminal is connected to the receiving circuit.

The above and further objects, aspects and novel features of the invention will become more fully apparent from the following detailed description when read in conjunction with the accompanying drawings.

DESCRIPTION OF THE PREFERRED EMBODIMENT

Figure 1:
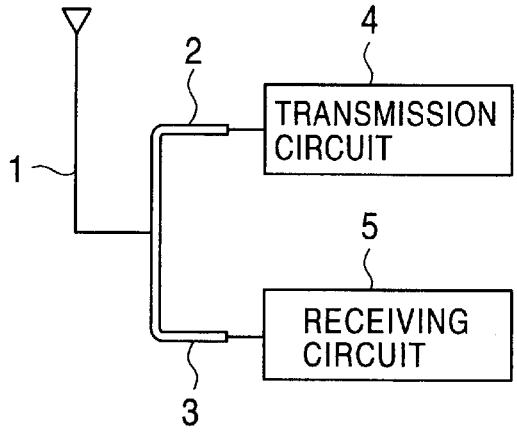
FIG. 1 is a block diagram showing the construction of an antenna duplexer of the present invention.

FIG. 1 shows a block circuit diagram of an antenna duplexer of the present invention. In FIG. 1, a first transmission line 2 and a second transmission line 3 are connected to an antenna 1, a transmission circuit 4 is connected to the antenna 1 in series with the first transmission line 2, and a receiving circuit 5 is connected to the antenna in series with the second transmission line 3.

Figure 5:
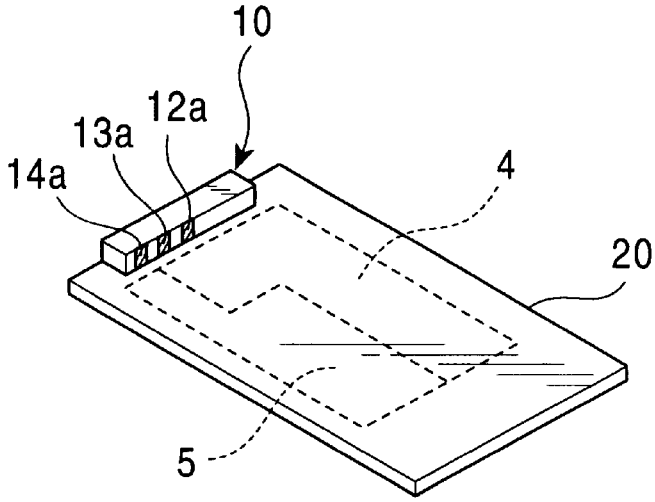
FIG. 5 is a perspective view showing an assembled antenna duplexer of the present invention.

The transmission circuit 4 and the receiving circuit 5 are formed on a printed-circuit board (see reference numeral 20 in FIG. 5). The first transmission line 2 and the second transmission line 3 are formed by, for example, conductors attached to the printed-circuit board. The length of the first transmission line 2 is set to be approximately a quarter of the wavelength of the transmission frequency, and the length of the second transmission line 3 is set to be approximately a quarter of the wavelength of the receiving frequency. Therefore, if the transmission frequency and the receiving frequency are the same, the lengths of the first transmission line 2 and the second transmission line 3 are equal.

The antenna 1 is usually formed by a line of a length of a half wavelength or a quarter wavelength, and impedance differs according to the length thereof. For example, in the case of a half wavelength, the impedance is about 73 ohms, and in the case of a quarter wavelength, the impedance is about 36 ohms. Also, generally, the input or output impedance of a circuit system (the transmission circuit 4, the receiving circuit 5, etc.) is designed to 50 ohms. Therefore, since $Zin=(Z_0 \times R)^{1/2}$, by appropriately setting the characteristic impedances of the first transmission line 4 and the second transmission line 5, it is possible to match the impedance of the antenna 1 with the output impedance of the transmission circuit 4. Similarly, it is possible to match the impedance of the antenna 1 with the input impedance of the receiving circuit 5. In the above-described equation, Zin is the impedance when viewed in a direction from the connection point of the antenna 1 and the transmission lines 2 and 3 to the transmission circuit 4 or the receiving circuit 5 side, $Z_0$ is the characteristic impedance of the transmission lines 2 and 3, and R is the output impedance of the transmission circuit 4 or the input impedance of the receiving circuit 5.

During reception, a received signal received by the antenna 1 is input to the receiving circuit 5 via the second transmission line 3. The received signal is also split to the first transmission line 2, and the signal is input to the output end of the transmission circuit 4. As a result, at the input end of the receiving circuit 5, the received signal is decreased slightly (approximately 3 dB), but this presents no problem in practice. Also, in the transmission circuit 4, since the received signal is input to the output end thereof, there is no particular problem, and during reception, since the supply of a power voltage to the transmission circuit 4 is in a stopped state, no problem is posed at all.

Figure 2:
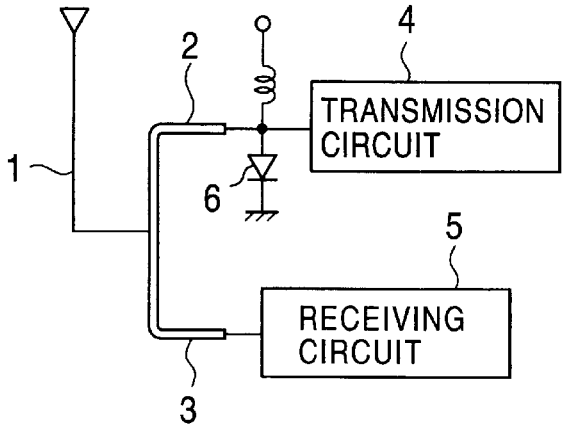
FIG. 2 is a block diagram showing another construction of the antenna duplexer of the present invention.

In a case where a decrease in level of the received signal input to the receiving circuit 5 becomes a problem, as shown in FIG. 2, if the connection point of the first transmission line 2 and the transmission circuit 4 is connected to a ground by a first switching diode 6, and if this first switching diode 6 is turned on during reception and is turned off during transmission, the received signal input to the transmission circuit 4 is totally reflected, thereby making it possible to prevent a decrease in level at the input end of the receiving circuit 5.

Figure 3:
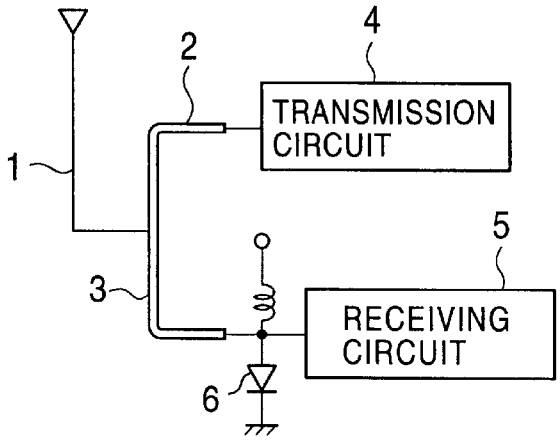
FIG. 3 is a block diagram showing still another construction of the antenna duplexer of the present invention.

On the other hand, during transmission, a transmission signal output from the transmission circuit 4 is input to the antenna 1 via the first transmission line 2. At this time, part of the transmission signal is split to the second transmission line 3 side, and the signal is input to the receiving circuit 5. During transmission, since the supply of a power voltage to be supplied to the receiving circuit 5 is stopped, no problem occurs in the receiving circuit 5. Also, since the signal is split to the second transmission line 3, transmission power emitted from the antenna 1 is decreased slightly (approximately 3 dB), but this hardly presents a problem, and this output decrease can be dealt with by increasing the output power of the transmission circuit 4. Alternatively, as shown in FIG. 3, if a second switching diode 7 is connected between the connection point of the second transmission line 3 and the receiving circuit 5 and a ground, and if this first switching diode 6 is turned on during transmission and is turned off during reception, the transmission signal is totally reflected at the input end of the receiving circuit 5, thereby making it possible to prevent the output power from being decreased.

Figure 4:
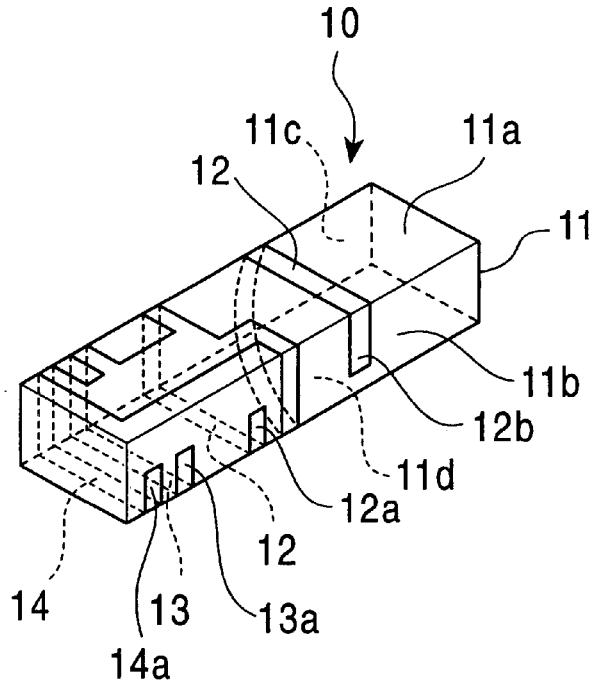
FIG. 4 is a perspective view showing the construction of an antenna block used in the antenna duplexer of the present invention.

FIG. 4 is a perspective view of an-antenna block 10 which is formed in such a way that the antenna 1, the first transmission line 2, and the second transmission line 3 which are used in the antenna duplexer of the present invention are formed on a dielectric block so as to be formed as one block part.

In FIG. 4, a dielectric block 11 in the form of a rectangular parallelepiped or a flat plate is formed of ceramic having a small dielectric loss. By printing a silver paste on a top surface 11*a* of the dielectric block 11, opposing sides 11*b* and 11*c*, and a bottom surface 11*d*, a first conductor in the form of a strip (first strip conductor) 12, a second conductor in the form of a strip (second strip conductor) 13, and a third conductor in the form of a strip (third strip conductor) 14 are formed. The length of the first strip conductor 12 is set to be a length of approximately half the wavelength of the transmission and receiving frequency, forming the antenna 1.

Also, the second strip conductor 13 and the third strip conductor 14 are formed in such a manner as to branch from nearly the center along the length of the first strip conductor 12, the lengths thereof are set to be a length of approximately a quarter of the wavelength of the transmission and reception frequency, the second strip conductor 13 forms the first transmission line 2, and the third strip conductor 14 forms the second transmission line 3.

A first terminal 12*a* connected to one of the end portions of the first strip conductor 12, a second terminal 13*a* connected to the end portion of the second strip conductor 13, and a third terminal 14a connected to the end portion of the third strip conductor 14 are formed on the side 11*b*.

The antenna block 10 constructed as described above, as shown in FIG. 5, is placed on a printed-circuit board 20 on which the transmission circuit 4 and the receiving circuit 5 are formed.

Then, by connecting the transmission circuit 4 to the second terminal 13*a*, it is connected to the first transmission line 2, and by connecting the receiving circuit 5 to the third terminal 14*a*, it is connected to the second transmission line 3.

Also, the first terminal 12*a* is connected to a grounding conductor (not shown) formed on the printed-circuit board 10. Therefore, other than the transmission circuit 4 and the receiving circuit 5, only the antenna block 10 needs to be mounted on the printed-circuit board 20.

Also, since the antenna 1, the first transmission line 2, and the second transmission line 3 are provided on the surface of the dielectric block 11, a necessary length can be obtained even if the dielectric block 11 is small, the size can be reduced, and assembly operations are simplified.

Figure 6:
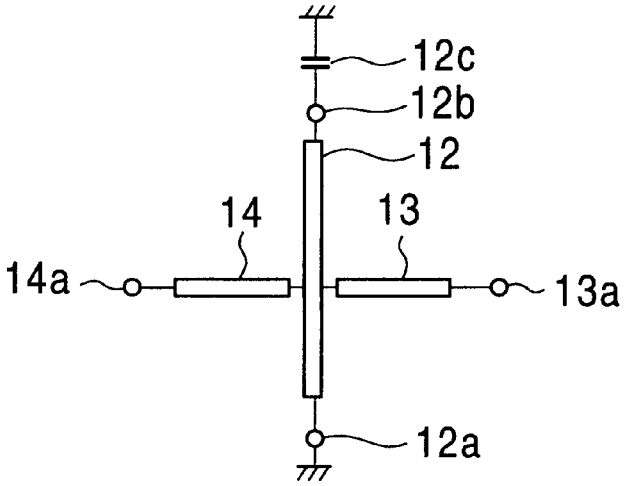
FIG. 6 is an equivalent circuit diagram of the antenna block used in the antenna duplexer of the present invention.
Figure 7:
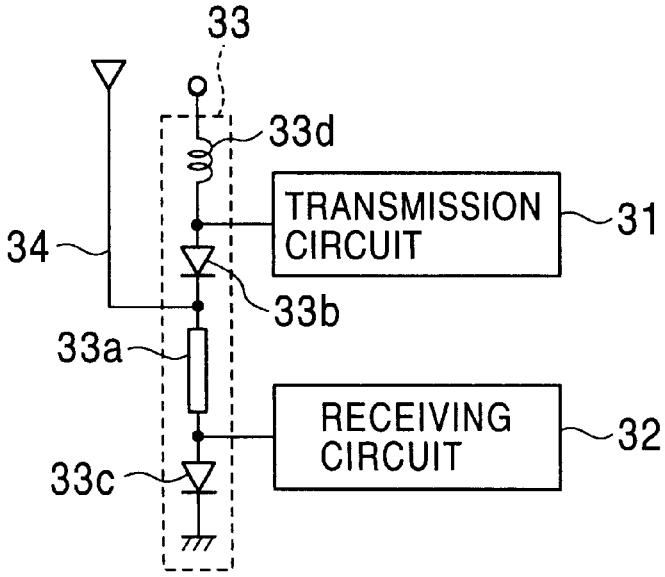
FIG. 7 PRIOR ART
FIG. 7 is a block diagram showing the construction of a conventional antenna duplexer.

If a fourth terminal 12*b* connected to the other, end portion of the first strip conductor 12 is provided on the side 11*d* of the dielectric block 11, and if the fourth terminal 12*b* is connected to a grounding terminal by a terminating capacitor 12*c* (see FIG. 6), the length of the first strip conductor 12 can be shortened.

As has thus been described, the antenna duplexer of the present invention comprises an antenna, a transmission circuit, a receiving circuit, a first transmission line for connecting the transmission circuit to the antenna, and a second transmission line for connecting the receiving circuit to the antenna, the length of the first transmission line is approximately a quarter of the wavelength of the transmission frequency, and the length of the second transmission line is set to be approximately a quarter of the wavelength of the receiving frequency. Therefore, even if an antenna switching circuit is not provided between the antenna and the transmission circuit or the receiving circuit, transmission and reception become possible, and costs can be reduced by decreasing the number of parts. Also, by appropriately setting the characteristic impedances of the first transmission line and the second transmission line, it is possible to match the impedance between the antenna and the transmission circuit with the impedance between the antenna and the receiving circuit.

Also, in the antenna duplexer of the present invention, a first switching diode for shunting the connection point of the first transmission line and the transmission circuit to a ground is provided, and the first switching diode is turned off during transmission and is turned on during reception, thereby making it possible to prevent the level of a received signal input to the receiving circuit from being decreased.

Also, in the antenna duplexer of the present invention, a second switching diode for shunting the connection point of the second transmission line and the receiving circuit to a ground is provided, and the second switching diode is turned off during reception and is turned on during transmission, thereby making it possible to prevent the level of a transmission signal sent from the antenna from being decreased.

Also, in the antenna duplexer of the present invention, a dielectric block in the form of a rectangular parallelepiped is provided, a first strip conductor, and second and third strip conductors which branch from nearly the center along the length of the first strip conductor are formed on the surface of the dielectric block, the first strip conductor is used as an antenna, the second strip conductor is used as a first transmission line, and the third conductor is used as a second transmission line. Therefore, the antenna, the first transmission line, and the second transmission line can be formed compact as an antenna block, and it is easy to reduce the size thereof, and the cost can be reduced.

Also, in the antenna duplexer of the present invention, a first terminal connected to the end portion of the first strip conductor, a second terminal connected to the end portion of the second strip conductor, and a third terminal connected to the end portion of the third strip conductor are formed on the surface of a dielectric block, a printed-circuit board, on which a transmission circuit and a transmission circuit are formed, is provided, the dielectric block is mounted on the printed-circuit board, the first terminal is connected to a grounding conductor provided on the printed-circuit board, the second terminal is connected to the transmission circuit, and the third terminal is connected to the receiving circuit. Therefore, assembly operations are simplified, and the size of the antenna duplexer can be reduced.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An antenna duplexer comprising:

an antenna;

a transmission circuit;

a receiving circuit;

a first transmission line to connect said transmission circuit to said antenna; and a second transmission line to connect said receiving circuit to said antenna, wherein a length of said first transmission line is approximately a quarter of a wavelength of a transmission frequency, and a length of said second transmission line is approximately a quarter of a wavelength of a receiving frequency, and wherein a dielectric block in the form of a rectangular parallelepiped dielectric block is provided, a first strip conductor, and second and third strip conductors which branch from approximately a center along a length of said first strip conductor are formed on a surface of said dielectric block, said antenna comprises said first strip conductor, said first transmission line comprises said second strip conductor, and said second transmission line comprises said third strip conductor.

2. An antenna duplexer according to claim 1, wherein a first terminal connected to an end portion of said first strip conductor, a second terminal connected to an end portion of said second strip conductor, and a third terminal connected to an end portion of said third strip conductor are formed on the surface of said dielectric block, a printed-circuit board, on which said transmission circuit and said receiving circuit are formed, is provided, said dielectric block is mounted on said printed-circuit board, said first terminal is connected to a grounding conductor provided on said printed-circuit board, said second terminal is connected to said transmission circuit, and said third terminal is connected to said receiving circuit.

3. An antenna duplexer according to claim 2, wherein the length of said first strip conductor is approximately half of the wavelength of the transmission and receiving frequency, and the lengths of said second and third strip conductors are approximately a quarter of the wavelength of their respective transmission and receiving frequencies.

4. An antenna duplexer according to claim 1, wherein the length of said first strip conductor is approximately half of the wavelength of the transmission and receiving frequency, and the lengths of said second and third strip conductors are approximately a quarter of the wavelength of their respective transmission and receiving frequencies.

5. An antenna duplexer comprising:

an antenna;

a transmission circuit;

a receiving circuit;

a first transmission line to connect said transmission circuit to said antenna; and a second transmission line to connect said receiving circuit to said antenna, wherein a length of said first transmission line is approximately a quarter of a wavelength of a transmission frequency, and a length of said second transmission line is approximately a quarter of a wavelength of a receiving frequency;

a first switching diode to shunt a connection point of said first transmission line and said transmission circuit to a ground, wherein said first switching diode is turned off during transmission of signals by the transmission circuit and is turned on during reception of signals by the receiving circuit, and wherein a dielectric block in the form of a rectangular parallelepiped dielectric block is provided, a first strip conductor, and second and third strip conductors which branch from approximately a center along a length of said first strip conductor are formed on a surface of said dielectric block, said antenna comprises said first strip conductor, said first transmission line comprises said second strip conductor, and said second transmission line comprises said third strip conductor.

6. An antenna duplexer according to claim 5, wherein a first terminal connected to an end portion of said first strip conductor, a second terminal connected to an end portion of said second strip conductor, and a third terminal connected to an end portion of said third strip conductor are formed on the surface of said dielectric block, a printed-circuit board, on which said transmission circuit and said receiving circuit are formed, is provided, said dielectric block is mounted on said printed-circuit board, said first terminal is connected to a grounding conductor provided on said printed-circuit board, said second terminal is connected to said transmission circuit, and said third terminal is connected to said receiving circuit.

7. An antenna duplexer according to claim 5, wherein the length of said first strip conductor is approximately half of the wavelength of the transmission and receiving frequency, and the lengths of said second and third strip conductors are approximately a quarter of the wavelength of their respective transmission and receiving frequencies.

8. An antenna duplexer according to claim 6, wherein the length of said first strip conductor is approximately half of the wavelength of the transmission and receiving frequency, and the lengths of said second and third strip conductors are approximately a quarter of the wavelength of their respective transmission and receiving frequencies.

9. An antenna duplexer comprising:

an antenna;

a transmission circuit;

a receiving circuit;

a first transmission line to connect said transmission circuit to said antenna; and a second transmission line to connect said receiving circuit to said antenna, wherein a length of said first transmission line is approximately a quarter of a wavelength of a transmission frequency, and a length of said second transmission line is approximately a quarter of a wavelength of a receiving frequency;

a second switching diode to shunt a connection point of said second transmission line and said receiving circuit to a ground, wherein said second switching diode is turned off during reception of signals by the reception circuit and is turned on during transmission of signals by the transmission circuit, and wherein a dielectric block in the form of a rectangular parallelepiped dielectric block is provided, a first strip conductor, and second and third strip conductors which branch from approximately a center along a length of said first strip conductor are formed on a surface of said dielectric block, said antenna comprises said first strip conductor, said first transmission line comprises said second strip conductor, and said second transmission line comprises said third strip conductor.

10. An antenna duplexer according to claim 9, wherein a first terminal connected to an end portion of said first strip conductor, a second terminal connected to an end portion of said second strip conductor, and a third terminal connected to an end portion of said third strip conductor are formed on the surface of said dielectric block, a printed-circuit board, on which said transmission circuit and said receiving circuit are formed, is provided, said dielectric block is mounted on said printed-circuit board, said first terminal is connected to a grounding conductor provided on said printed-circuit board, said second terminal is connected to said transmission circuit, and said third terminal is connected to said receiving circuit.

11. An antenna duplexer according to claim 10, wherein the length of said first strip conductor is approximately half of the wavelength of the transmission and receiving frequency, and the lengths of said second and third strip conductors are approximately a quarter of the wavelength of their respective transmission and receiving frequencies.

12. An antenna duplexer according to claim 9, wherein the length of said first strip conductor is approximately half of the wavelength of the transmission and receiving frequency, and the lengths of said second and third strip conductors are approximately a quarter of the wavelength of their respective transmission and receiving frequencies.

* * * * *